US005582345A

United States Patent [19]

Lankhuijzen

[11] Patent Number: 5,582,345

[45] Date of Patent: Dec. 10, 1996

[54] PACKAGING FOR CONSUMER GOODS

[75] Inventor: Jan P. Lankhuijzen, Eindhoven, Netherlands

[73] Assignee: EMI Compact Disc (Holland) B.V., Ah Uden, Netherlands

[21] Appl. No.: 527,251

[22] Filed: Sep. 12, 1995

[30] Foreign Application Priority Data

Oct. 8, 1994 [GB] United Kingdom ..... 9420338

[51] Int. Cl.[6] ..... B65D 5/54

[52] U.S. Cl. ..... 229/235; 229/240; 229/242; 229/925

[58] Field of Search ..... 229/121, 235, 229/240, 242, 243, 244, 925; 206/44 R

[56] References Cited

U.S. PATENT DOCUMENTS

| | | | |
|---|---|---|---|
| 3,197,110 | 7/1965 | Neuman et al. | 229/244 |
| 3,542,192 | 11/1970 | Steck | 229/235 |
| 3,581,973 | 6/1971 | Turpin | 229/121 |
| 3,884,348 | 5/1975 | Ross | 229/235 |
| 4,000,811 | 1/1977 | Hardison et al. | 229/242 |
| 4,008,849 | 2/1977 | Baber | 229/235 |
| 4,058,206 | 11/1977 | Morse et al. | 206/44 R |
| 4,113,100 | 9/1978 | Soja et al. | 229/235 |
| 4,421,229 | 12/1983 | Pan et al. | 206/44 R |
| 4,815,609 | 3/1989 | Kiedaisch | 229/240 |
| 5,167,324 | 12/1992 | Miller | 229/242 |

FOREIGN PATENT DOCUMENTS

| | | | |
|---|---|---|---|
| 1328464 | 4/1963 | France | 229/235 |
| 2581971 | 11/1986 | France . | |
| 2236414 | 2/1974 | Germany | 229/240 |
| 2541736 | 3/1977 | Germany | 229/235 |
| 2917795 | 8/1980 | Germany | 229/235 |
| 2088830 | 6/1982 | United Kingdom | 229/235 |

*Primary Examiner*—Gary E. Elkins
*Attorney, Agent, or Firm*—Keck, Mahin & Cate

[57] ABSTRACT

In order to permit opening of a box for Compact Discs regardless of the orientation of the box in a rack system, the box has two tear strips (42, 52) extending around the box at right angles to one another. The base and sides are formed as panels (6,8*a,b*) , the ends are formed from end panels (14*a*–18*b*) connected by fold lines to the base and side panels, and the top is formed by flaps (10*a*, 10*b*) connected by fold lines to the side panels, wherein the end panels and side panels are formed with perforations (34*a–d*) to define a first tear strip (42) extending around the periphery of the box between the top and base for separating the box into two halves (60, 62) and wherein the end panels and the base panel are formed with perforations (50*a, b*) to define a second tear strip (52) for separating the box into two further halves (64, 66), with one side panel in each half.

10 Claims, 6 Drawing Sheets

PACKAGING FOR CONSUMER GOODS

FIELD OF THE INVENTION

This present invention relates to boxes of cardboard or like material for transporting consumer goods, particularly though not exclusively packs of compact discs (CD's).

BACKGROUND ART

It is a common requirement in the music industry to package packs of CD cassettes (commonly known as "jewel boxes"), say 25 CD's, the cassettes being positioned face to face, one behind the other. There are various types of packaging in common use, but they all have a shape conforming to the shape of the CD pack, namely a narrow rectangular box having a similar cross-section to that of the CD cassette and of a length sufficient to accommodate the CD pack. Such packaging is frequently designed to be opened in one specific orientation.

A problem has arisen in modem storage systems in warehouses and shops which include flow-racks, in which packages move under gravity on roller ways, where it is not possible to maintain the package in a specific orientation, for example because locations are allocated for the package which are smaller than the width dimension of the pack in its normal orientation. Thus after processing in the storage system, the package may be disposed in an orientation, for example on its side, in which it is not convenient or possible to open the package. This is a problem where speedy and efficient access to the CD's is required, particularly if it is required to remove only some of the CD's from the pack and to leave the remainder in place in the package in the storage system.

Packages in common use are as follows:

1. Shallow trays in which the CD pack is positioned, the whole being covered in shrink-wrapping. This can conveniently only be opened with the tray lowermost, and if the tray is disposed on its side, then it is not convenient to open the package and to remove only some of the CD's without risk of spilling the remainder.

2. A wrap-around box wherein a cardboard blank is folded around the CD pack. To access the pack, the box has to be opened at one end and the CD's removed individually. Otherwise the box has to be removed from its position and cut or torn open, which is clearly inconvenient.

3. A box with a lid. This implies the box should be stored on its base with the lid uppermost. If the box is disposed on its side, then access becomes difficult.

4. A simple shrink-wrapped covering around the pack. This is structurally not strong enough for conveyor belt systems and further cannot be opened without destruction of the package. Thus it is not possible to extract some CD's and to leave the rest in place.

A design of cardboard box, not specifically indended for CD's, which provides a display function, is shown in FR-A-2581971. The box is of the wrap-around type with tear strips which enable the whole of the top of the box, or just a front quadrant of the box, to be removed from the remainder so that the objects within the box can be displayed without removing them. Similarly, U.S. Pat. No. 4,113,100 and U.S. Pat. No. 3,884,348 disclose cardboard boxes having tear strips for separating the boxes into two halves so that the lower half can function as a display tray for the contents. None of these references is specifically designed for CD's, and all of these references require opening to take place in one specific orientation of the box.

SUMMARY OF THE INVENTION

It is an object of the invention to provide a package for consumer goods which can easily be opened and its contents accessed, without requiting the package to be disposed in one specific orientation.

The present invention provides a box formed of cardboard or like material having a top, base, sides and ends, wherein the base and sides are formed as panels of said material, the ends are formed from end panels connected by fold lines to the base and side panels, and the top is formed by two or more flaps connected by fold lines to the side panels, wherein the end panels and side panels are formed with a first set of perforations to define a first tear strip extending around the periphery of the box between the top and base for separating the box into two halves, and wherein the end panels and the base panel are formed with a second set of perforations thereby to define a second tear strip for separating the box into two further halves, with one side panel in each half.

In accordance with the invention, the box may be simply opened in the position in which it is stored without having to re-orientate the box. Thus if the box is disposed in its "correct" position with the base panel at the bottom, it is possible to open the box by means of the first tear-strip running through the side panels so that the entire upper half of the box can be removed to expose the CD pack, whereby a required number of CD cassettes may be removed, leaving the remainder in place.

If, however, the box is disposed on its side with a side panel lowermost, then the box may be opened by means of the tear-strip running through the base panel and end panels, whereby the top half of the box containing the top side panel may be removed, to expose the contents of the box.

In addition, the top flaps of the box may be opened so as to gain access to the box for adding promotional material, etc. It would normally be inconvenient to extract the CD's merely by opening the top flaps. The top flaps would normally be formed as one flap connected along a fold line to each side panel and extending approximately half way across the top of the box. In this way if the tear-strip extending through the base panel is positioned at the centre line of the base panel, then when the tear-strip is removed, the top flaps will not interfere with the removal of one half of the box. However, other configurations of top flap are in principle possible, for example, only one top flap extending from one side panel over the whole top region. In addition, the top flap or flaps may have connected thereto, through fold lines or perforated lines, end extension panels which when the flaps are positioned over the top of the CD pack, may be folded down over the end panels and secured thereto, for example, by adhesive in order to maintain the top flaps in place. When it is desired to open the top flaps it is merely necessary to pull the top flaps upwards so that the top panels tear along the perforated lines, or alternatively, to release the end panels by breaking the adhesive bond.

As preferred, the end panels extending from the base and side panels are so dimensioned that the perforation lines running therethrough defining the first tear-strip does not overlap with any of the other base panels, since otherwise it would be necessary to have tear-strips through two or three layers of end panels. In a preferred arrangement, the end panels attached to the side panels extend only half way or less than half way across the ends of the box. In this way they adjoin or define a small gap at the centre line of the ends, and if the second tear-strip running through the base panel and associated end panels is positioned at the centre line of the base panel, then this tear-strip coincides with the gap between the end panels of the side panels, so that the end panels do not interfere with the operation of the tear strip.

In a further aspect, the present invention extends to a blank of cardboard or like material for forming the box as set forth above and comprises, a first set of parallel fold lines extending across the blank for defining a base panel, first and second side panels adjoining the base panel, and one or more top flaps attached to the side panels, a second set of parallel fold lines at right angles to the first set of fold lines defining end panels connected to the base panel and first and second side panels, a first set of perforated lines extending through the first and second side panels and associated end panels for defining a first tear-strip, and a second set of perforated lines extending through the base panel and associated end panels to define a second tear-strip.

BRIEF DESCRIPTION OF THE DRAWINGS

A preferred embodiment will now be described by way of example with reference to the accompanying drawings wherein.

DESCRIPTION OF THE PREFERRED EMBODIMENT

Figure 1:
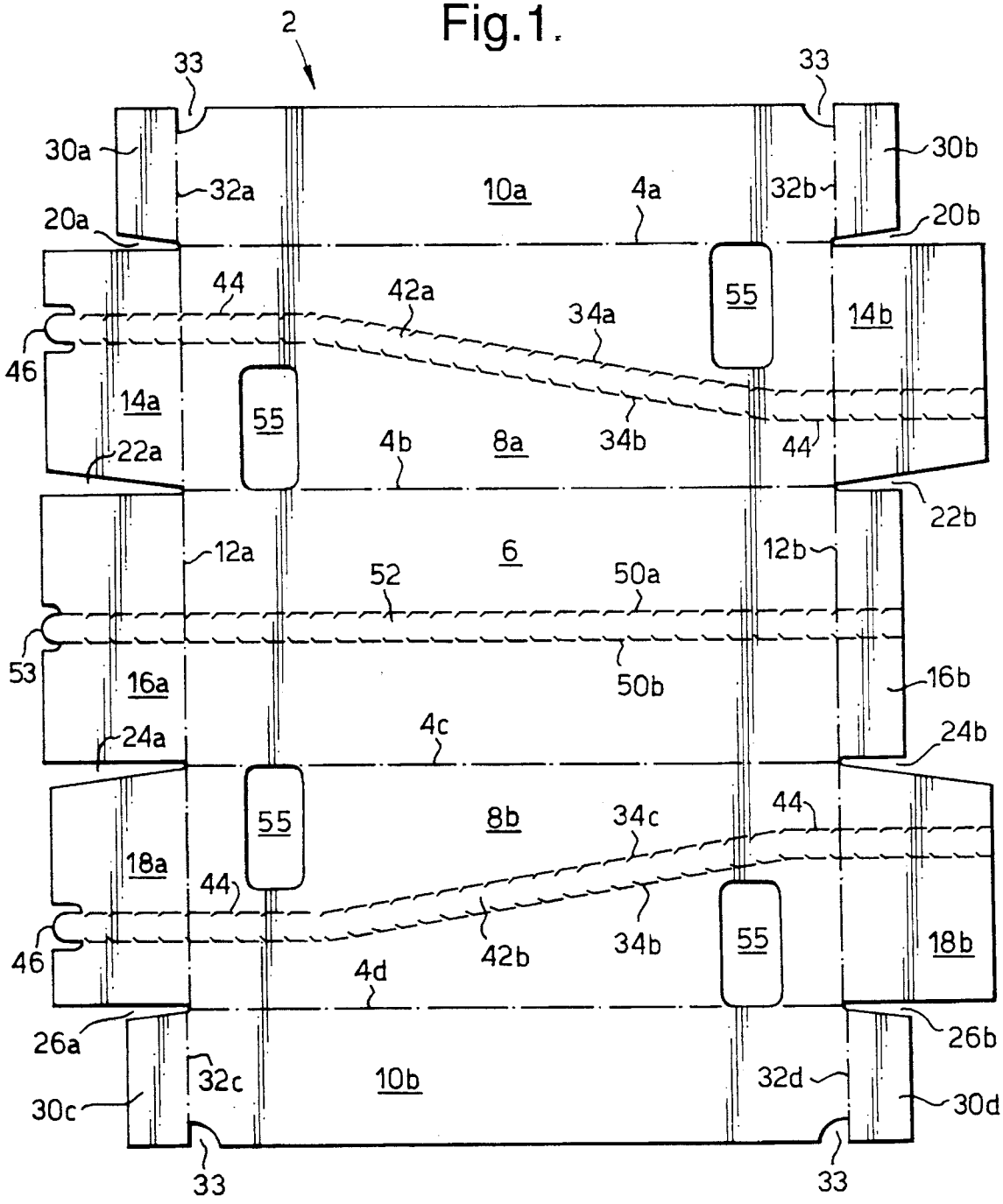
FIG. 1 is a plan view of a cardboard blank for forming the box according to the invention.

It will be understood that the drawings illustrate a box for holding a pack of 25 CD cassettes or jewel boxes. The cassettes are entirely conventional in construction, being flat rectangular boxes with one end having an access portion for the CD, resulting in a cassette with a length dimension of 141 mm and a width dimension of 124 mm.

Referring now to FIGS. 1 to 8, FIG. 1 discloses a blank 2 of cardboard for forming a box comprising a first set of parallel fold lines 4*a*, 4*b*, 4*c* and 4*d* for defining a central base panel 6 of rectangular form and a width (142 mm) slightly more than that of a CD cassette, adjoining side panels 8*a*, 8*b*, of rectangular shape and having a width equal to the width dimension of a CD (124 mm), and first and second top flaps 10*a*, 10*b*, adjoining respective side panels 8*a* and 8*b*. A second set of fold lines 12*a* and 12*b* running across the blank at right angles to the first fold line set, defines end panels 14*a*, 14*b*, 16*a*, 16*b* and 18*a*, 18*b*, extending respectively from first side panels 8*a*, base panel 6 and second side panel 8*b*. The end panels are further defined by inwardly extending V-shaped cut lines 20*a*, 20*b*, 22*a*, 22*b*, 24*a*, 24*b*, and 26*a*, 26*b* extending from the periphery of the blank to junctions between the first and second fold line sets. It will be noted that the width of the end panels 14, 18 adjoining the side panels 8 are of a width (72 mm) that in the assembled box them is a gap between adjoining end panels (see below). The width of the end panel 16*b* extending from base panel 6 is substantially less than the width of the other base panels.

End extensions 30*a*, *b*, *c*, *d*, extend from perforation lines 32*a*, *b*, *c*, *d*, at the end edges of top flaps 10*a*, *b*, which lines of perforations are aligned with fold lines 12*a*, *b*. Recesses 33 having the form of quarter circles are disposed at the free ends of perforation lines 32*a–d*.

Figure 2:
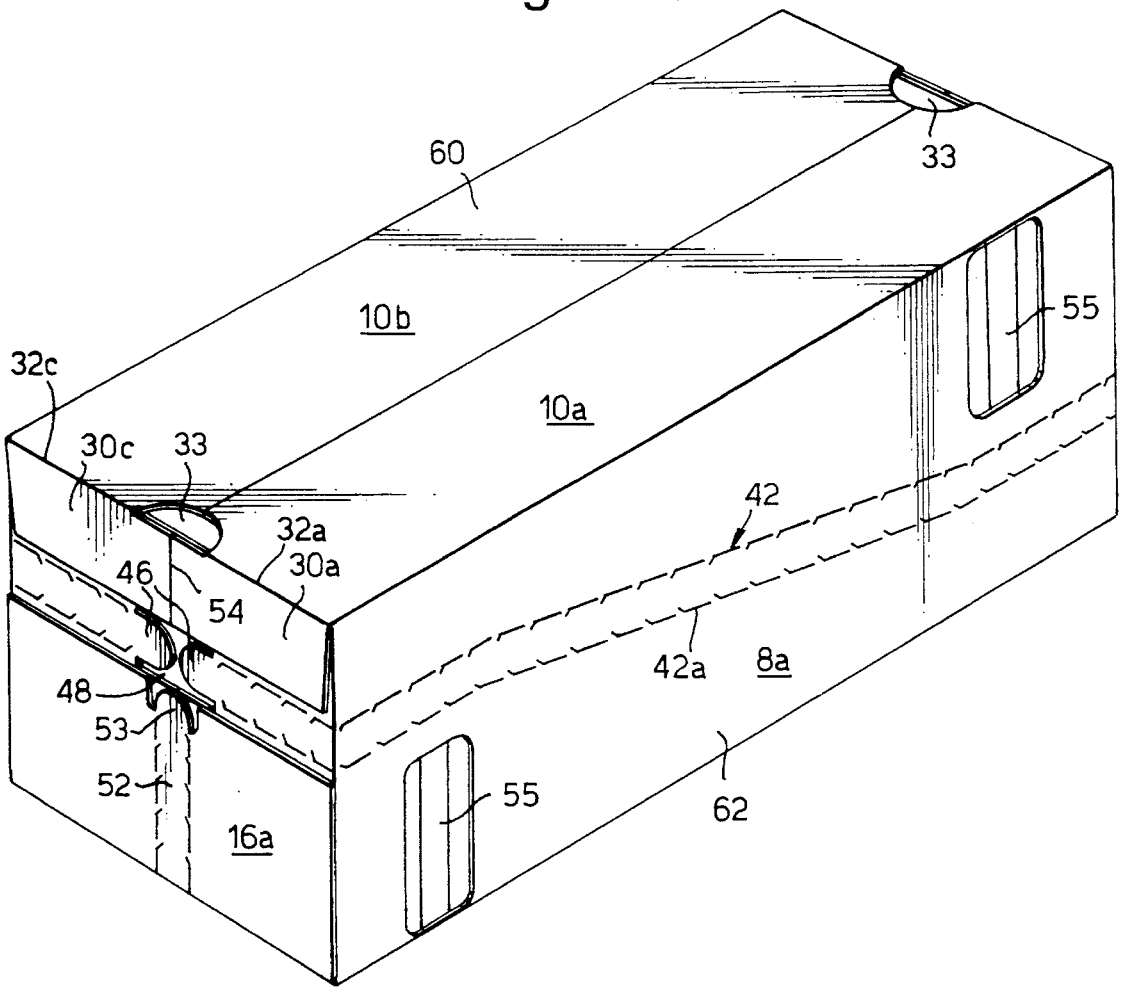
FIGS. 2 to 5 are perspective views of the box in the assembled condition holding a pack of CD's in various orientations.
Figure 3:
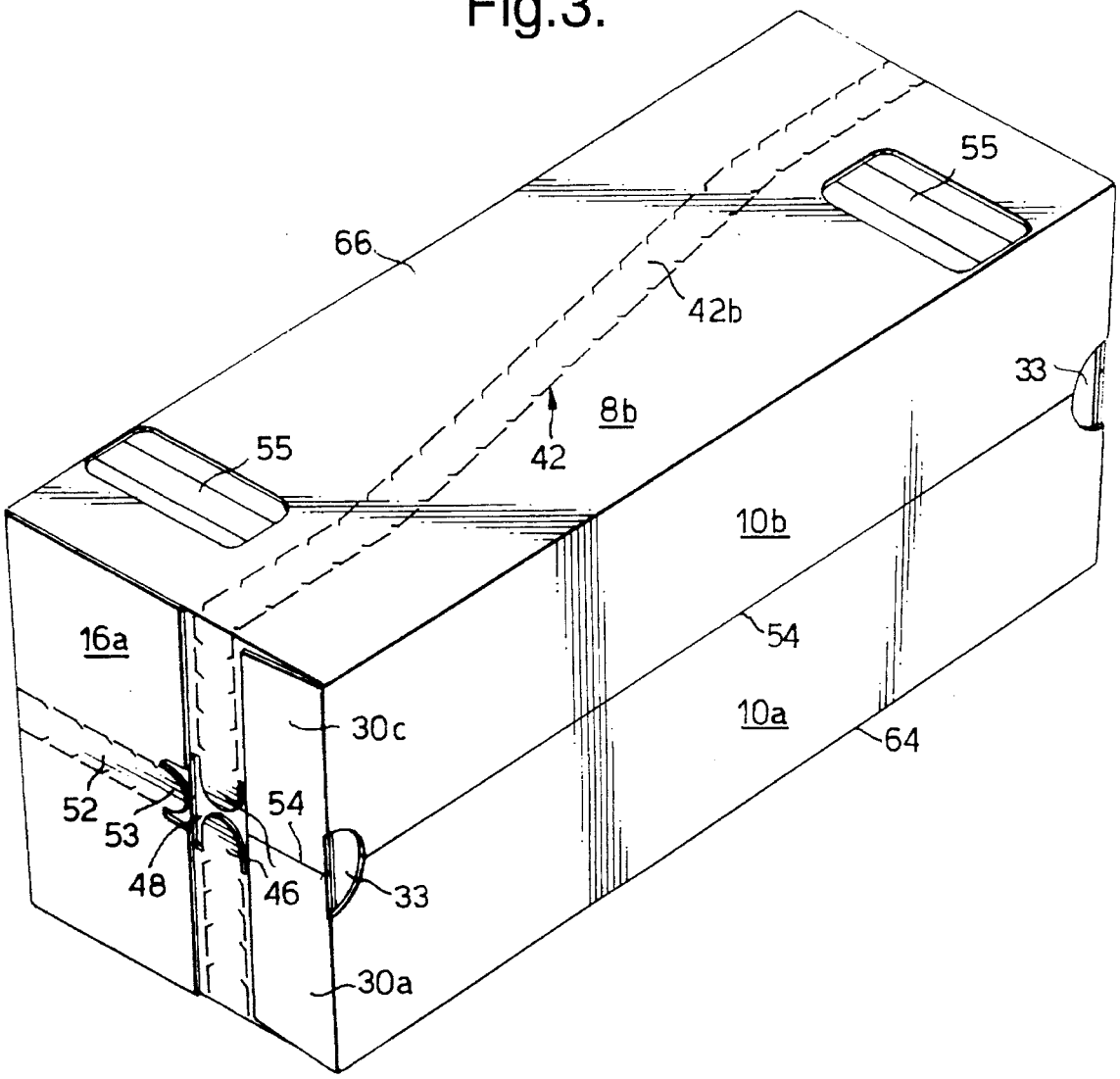
Figure 4:
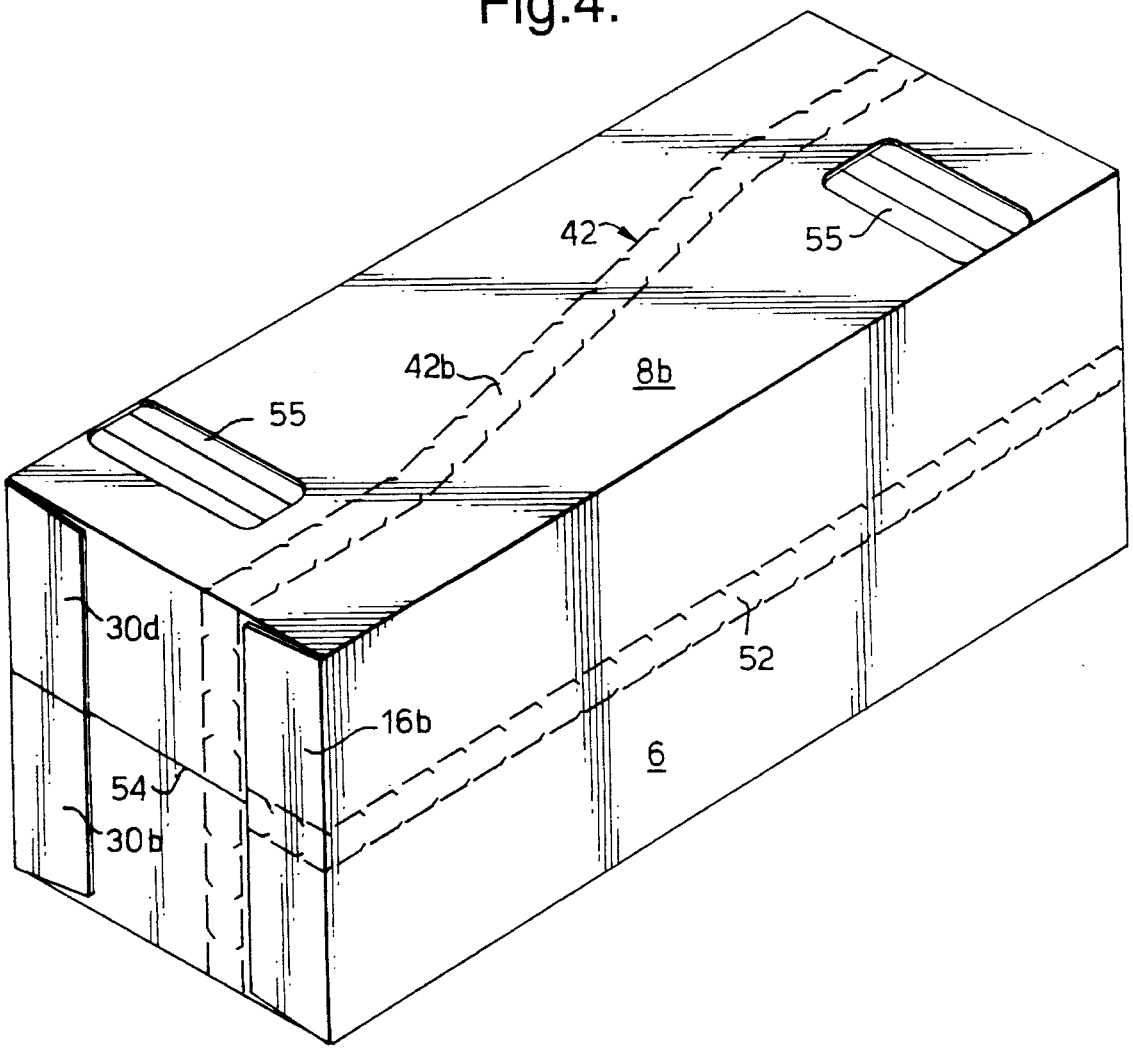
Figure 5:
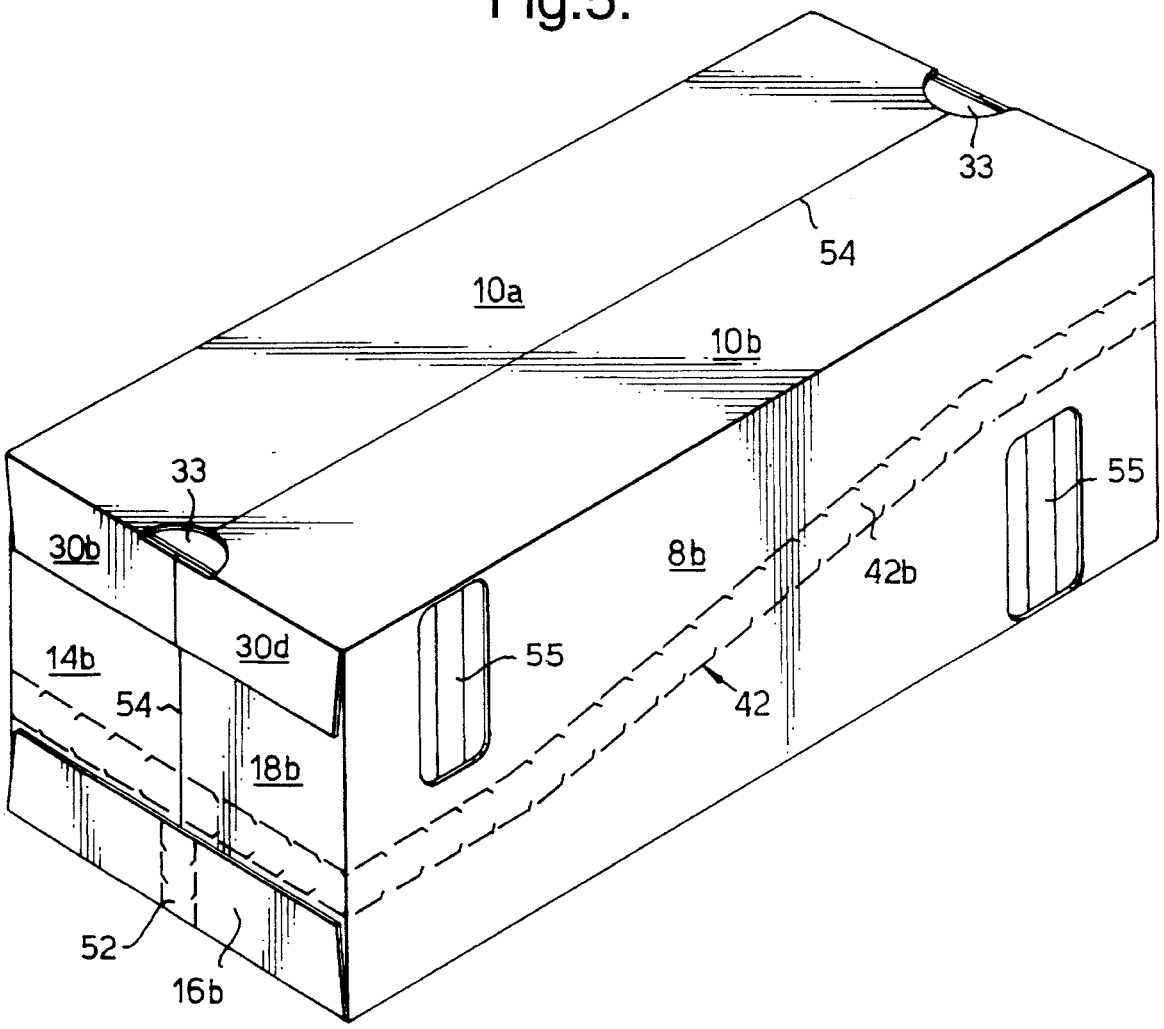
Figure 6:
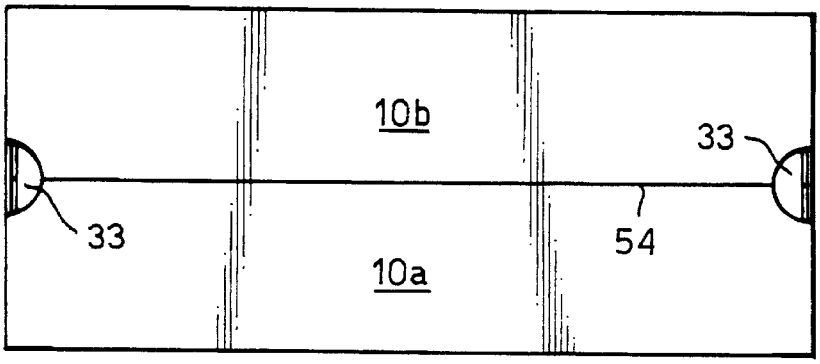
FIGS. 6 through 10 are top, front, side, back and bottom views, respectively, of the assembled box.
Figure 7:
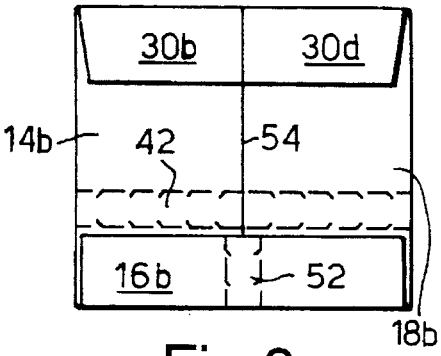

A first set of perforations comprising lines of perforations 34*a*, *b*, *c*, *d*, extend across side panels 8*a*, *b*, and associated end panels 14*a*, *b*, 18*a*, *b*, in order to define two halves 42 *a,b* of a first tear-strip 42 (see FIGS. 2 to 5); these perforations have the form of "sharks teeth" i.e., having a parallel portion and an inwardly extending portion. Tear-strip 42 extends across side panels 8 making a small angle over most of its length with the centre line of side panels 8, and extends across end panels 14, 18 and a small part of side panels 8*a*, *b*, in the region indicated at 44, in a direction parallel to centre line of panel 8. Tear strip halves 42*a,b* terminate at one end in arcuate recesses 46 which in the assembled box form "apple-core" shaped finger recess 48 (FIGS. 2,3).

A second set of perforations comprising parallel lines of perforations 50*a*, 50*b* extend across the centre line of base panel 6 and associated end flaps 16*a*, *b*, in order to define a second tear-strip 52. Tear-strip 52 terminates at one end in an arcuate recess 53 of a shape similar to that of recesses 48.

In addition, display apertures 55 are provided in side panels 8*a,b* on either side of tear-strip 42. In order to view information printed on the spines of cassettes within the box.

When the blank is assembled, the end panels 14, 16, 18 are fixed together by adhesive and the end flaps 30*a*, *d* are folded down and fixed or bonded to the end panels, in order to provide the box as shown in FIGS. 2–10.

Figure 9:
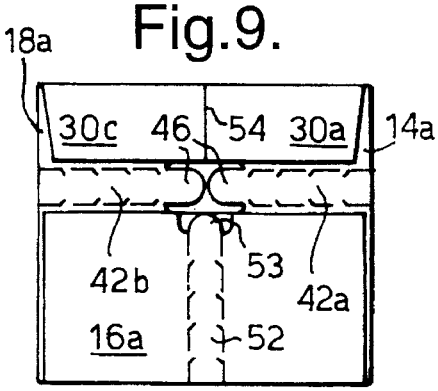
Figure 8:
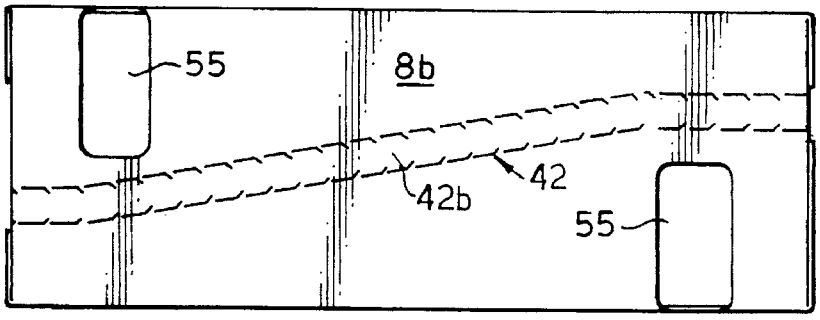
Figure 10:
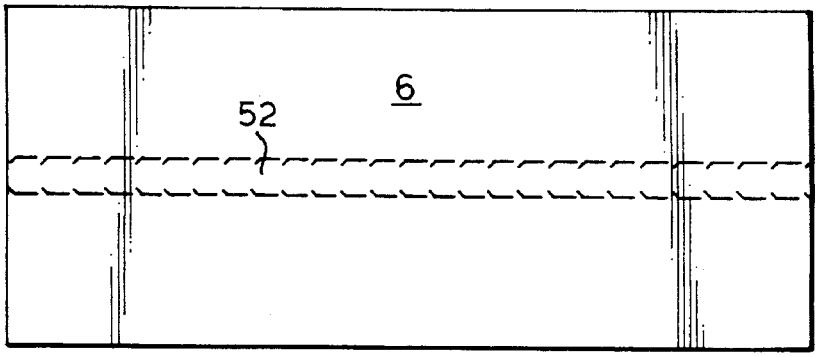

Referring to FIG. 9 particularly, that is the back view of the ends of the box, it may be seen that tear-strip halves 42*a,b* terminate in recesses 46, in order to define an apple-core shaped aperture 48 for an operator to insert a finger in order to begin tearing of the tear-strip. In addition, tear-strip 52 running around the base of the box terminates in a recess 53 adjacent the aperture 48 to provide a means of accessing the end of tear-strip 52. It may also be seen, particularly in FIGS. 7 and 9 that the end panels 14*a*, 18*a* adjoin one another at their free ends to define a gap 54 which is collinear with tear-strip 36. In addition, this gap 54 is coextensive with the gap between the flap extension panels 30*b*, *c* (FIG. 7) and 30*a*, *d* (FIG. 9).

Thus, referring particularly to FIGS. 2 to 5, in use of the box according to the invention, in a modern storage system, the box, when it is desired to access the contents of the box, may have the normal orientation shown in FIG. 2 with the base panel lowermost or may have the orientation shown in FIG. 3 i.e., on its side with one of the side panels lowermost. For the normal orientation shown in FIG. 2 if it is desired to access the contents of the box, it is merely necessary, without moving the box, to tear open the box by means of tear-strip 42. In order to do this, the operator will insert a finger into aperture 48 at one end of the box to grip the end of the tear-strip and then to tear open the tear-strip which extends on each side panel of the box in two separate halves and terminates at the aperture 48 at the back of the box.

Having done this it is possible to remove an upper half 60 of the box, leaving the pack of CD cassettes or jewel boxes exposed in the lower part of the box 62. It may be seen that part 62 has the form of a display tray in that the front of the tray (end panel 16*b*) is relatively small in height whereas the back of the tray (end panel 16*a*) is relatively high.

If on the other hand the box has the orientation as shown in FIG. 3, then in order to open the box without disturbing the orientation, it is necessary to access tear-strip 52 via apertures 53. Tear-strip 52 extends around the base of the box and hence the tearing out of the tear-strip 52 will release only one half of the box. However, since as described above, the end panels 14, 18 adjoin along a separation gap 54 collinear with tear-strip, 52, and the separation line between top flaps 10 is also collinear with tear strip 52, then once tear-strip 52 has been removed, it is possible to then separate the box into two halves 64, 66. Thus, top half 66 may be removed to expose the pack of CD cassettes.

Finally, in the position shown in FIG. 2, the box may be opened by pulling open the top flaps 10*a*, 10*b* at recess 33. The flap extensions 30*a–d* will then either separate from the flaps along perforated lines 32*a–d* or the adhesive bond with the end panels will be broken. Then it is possible to for example insert brochures of promotional material into the top of the box or to extract the same. After opening of the top flaps, the box can be resealed by for example sticking the flaps down with tape.

Whilst the preferred embodiment has been described with reference to the packaging of CD's, it will be understood that then consumer goods may be packed in the box of the invention, for example music cassettes (MC's). Since these are one half the width of a CD, the MC's can be packed two side by side to form a double pack of MC's within the box. The box height dimension may remain the same as for CD's or may be adapted to fit more closely to the MC pack.

We claim:

1. A box formed of cardboard material having a top, base, sides and ends, wherein the base and sides are formed as a base panel and side panels of said material, the ends are formed from base end panels connected by fold lines to the base panel and by side end panels connected by fold lines to the side panels, and the top is formed by first and second top flaps connected by fold lines to respective said side panels, wherein said side end panels and said side panels are formed with a first set of perforations to define a first tear strip extending around a periphery of the box between the top and the base for separating the box into two halves and wherein the base end panels and the base panel are formed with a second set of perforations thereby to define a second tear strip for separating the box into two further halves with one side panel in each half.

2. A box according to claim 1 wherein said first and second top flaps each extend approximately halfway across the top to define a narrow gap therebetween.

3. A box according to claim 1, wherein each of the first and second top flaps has end extensions connected thereto across perforation lines, said end extensions overlapping and being affixed to said side end panels.

4. A box according to claim 1 wherein the first tear strip is disposed so as not to overlap with said base end panels.

5. A box according to claim 4, wherein a first base end panel is relatively narrow and a second base end panel is relatively wide so as to provide a display tray when the first tear strip is operated to divide the box into two halves.

6. A box according to claim 1, wherein said side end panels are dimensioned so as to define a narrow gap therebetween.

7. A box according to claim 6, wherein the first tear strip is divided into two halves by said gap, and recesses are provided in the side end panels to define an aperture at said gap for finger access to the first tear strip for tearing thereof.

8. A box according to claim 6 wherein the second tear strip is collinear with the narrow gap.

9. A box according to claim 7 wherein the second tear strip is collinear with the narrow gap and wherein the second tear strip terminates adjacent said aperture.

10. A blank of cardboard or like material for forming a box comprising, a first set of parallel fold lines extending across the blank for defining a base panel first and second side panels adjoining the base panel, and one or more top flaps attached to the side panels, a second set of parallel fold lines at right angles to the first set of fold lines defining end panels connected to the base panel and first and second side panels, a first set of perforated lines extending through the first and second side panels and associated end panels for defining a first tear strip and a second set of perforated lines extending through the base panel and associated end panels to define a second tear strip.

* * * * *